United States Patent [19]

Unger

[11] Patent Number: 4,847,938

[45] Date of Patent: Jul. 18, 1989

[54] CLEANING APPARATUS, PARTICULARLY FOR CLEANING WINDOW PANES

[76] Inventor: Henry M. Unger, 24 Sunset Dr., Weston, Conn. 06880

[21] Appl. No.: 156,871

[22] Filed: Feb. 18, 1988

[30] Foreign Application Priority Data

Mar. 16, 1987 [DE] Fed. Rep. of Germany ..... 3708463

[51] Int. Cl.[4] ..... A47L 1/06

[52] U.S. Cl. ..... 15/245; 15/144 R; 30/330

[58] Field of Search ..... 15/245, 236, 144 R; 30/169, 330, 331

[56] References Cited

U.S. PATENT DOCUMENTS

| | | | |
|---|---|---|---|
| 742,590 | 10/1903 | Cattelle | 15/245 |
| 1,133,419 | 3/1915 | Whitlock . | |
| 1,579,941 | 4/1926 | Jenkins | 15/245 |
| 2,681,464 | 6/1954 | Baril | 15/245 X |
| 2,905,960 | 9/1959 | Ward | 15/245 |
| 3,408,676 | 11/1968 | Cayo | 15/245 X |

*Primary Examiner*—Peter Feldman

*Attorney, Agent, or Firm*—John C. Smith, Jr.

[57] ABSTRACT

A cleaning apparatus, particularly for cleaning window panes includes a shaft-like hollow handle and a replaceable approximately strip-shaped cleaning tool mounted between two clamping jaws which are adjustable relative to one another. One of the clamping jaws has an extension by with which it is connected to the handle by means of a hinged bolt. This cleaning apparatus is superior as compared with usual apparatuses in that the extension of the one clamping jaw is pivotably connected to an elongation of the handle and comprises at its broad side facing away from the elongation an arcuately extending, relatively coarse toothing which is in cooperation in a manner known per se with a spring-loaded stop lever guided in the handle and formed as a slide.

6 Claims, 1 Drawing Sheet

CLEANING APPARATUS, PARTICULARLY FOR CLEANING WINDOW PANES

BACKGROUND OF THE INVENTION

This invention relates to a cleaning apparatus, particularly for cleaning window panes, which comprises a shaft-like hollow handle and a replaceable, approximately strip-shaped cleaning tool mounted between two clamping jaws being adjustable relative to one another, an extension being provided at one of the clamping jaws, connecting the clamping jaw to the handle by means of a hinged bolt.

Such cleaning apparatuses which are insertable with their handle in a preferably telescopic shaft-like handle extension and the clamping jaws of which are pivotable together with the cleaning tool are known. For the case that the person using the apparatus stands in front of the window pane to be cleaned, the clamping jaws are arranged rectangularly relative to the handle and the shaftlike extension thereof. The person using the apparatus is able to clean the window pane in this case in an effective manner in paths from top to bottom. However, when the person using the apparatus is forced, due to space conditions, to stand laterally of the window pane to be cleaned, the clamping jaws may be adjusted, relative to the oblique position of the handle and the shaft-like extension thereof forced by the position, to such an angle that the window pane may likewise be cleaned in paths from top to bottom. In the case of the known cleaning apparatuse the clamping jaws with the cleaning tool may be clamped by means of the hinged bolt to a certain extent in the required angular position. The clamping is, however, not sufficient in order to prevent unintentional displacement of the clamping jaws during the cleaning of the window pane.

SUMMARY OF THE INVENTION

An object of the present invention is to avoid the above-mentioned disadvantage and to improve a cleaning apparatus of the kind mentioned at the beginning so that the clamping jaws with the cleaning tool may be arrested in the adjusted position relative to the handle and the shaft-like extension in a simple way in such a manner that unintentional displacement of the clamping jaws is safely avoided.

To attain this object, the present invention provides a cleaning apparatus, particularly for cleaning window panes, comprising a shaft-like hollow handle and a replaceable, approximately strip-shaped cleaning tool which is mounted between two clamping jaws being adjustable relative to one another, an extension being provided at one of the clamping jaws, connecting said clamping jaw to said handle by means of a hinged bolt; said extension of one of the clamping jaws being pivotably connected to an elongation of the handle and having at its broad side facing away from said elongation an arcuately shaped, relatively coarse toothing; said toothing being in cooperation in a manner known per se with a stop lever guided in said handle, said stop lever being formed as a slide, provided with a grip and loaded by a compression spring.

For the purpose of arresting the clamping jaws, the stop lever is pushed out of the open front end of the handle by slidingly pressurizing its grip against the action of the compression spring and is engaged in a gap of the coarse toothing corresponding to the position of the clamping jaws relative to the handle, in which engagement position it is secured when the pressure action on the grip decreases. The clamping jaws together with the cleaning tool are secured by this measure against unintentional displacement during the cleaning of the window pane.

In an advantageous development of the cleaning apparatus, the teeth of the toothing comprise at their blunt faces a fine toothing and the stop lever is provided at its front end with a tooth-like extension by means of which it is in cooperation with the fine toothing.

For the case that an arresting of the clamping jaws in the adjusted position is not possible by means of the coarse toothing, use is made of the fine toothing to achieve an arresting.

BRIEF DESCRIPTION OF THE DRAWING

An embodiment of the invention will now be described by way of example and with reference to the accompanying drawing in which.

DESCRIPTION OF THE PREFERRED EMBODIMENT

Figure 2:
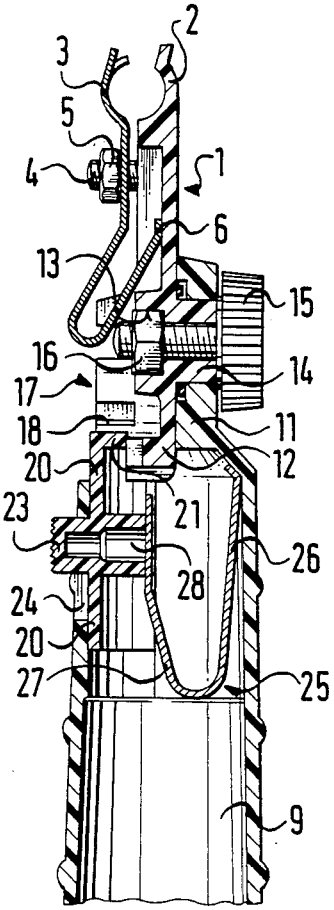
FIG. 2 is a sectional view on the line A—A in FIG. 1.
Figure 1:
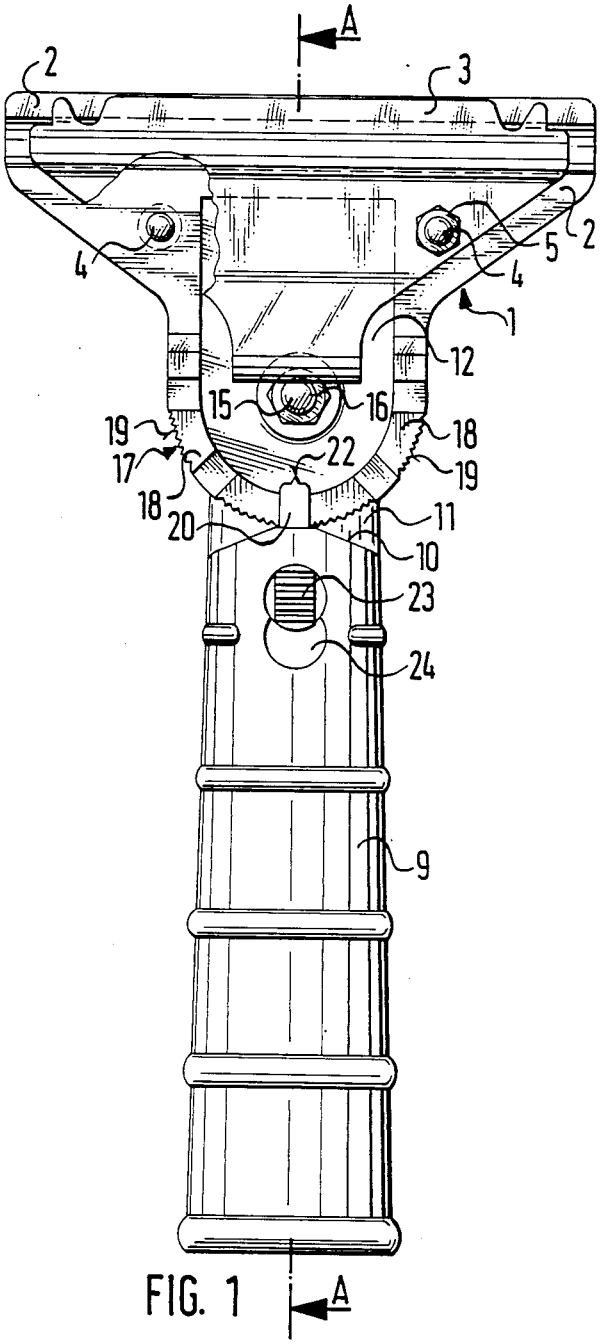
FIG. 1 is a rear view, partly torn up, of the cleaning apparatus without cleaning tool.
Figure 3:
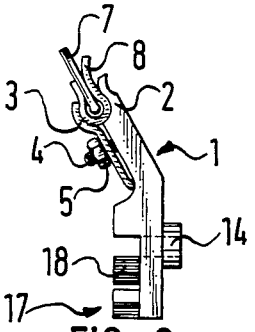
FIG. 3 is a side elevational view of the clamping jaws with the cleaning tool.

FIGS. 1–3 illustrate a cleaning apparatus, particularly for cleaning window panes, having a head 1 being composed of two clamping jaws 2 and 3. The clamping jaw 3 is connected to the clamping jaw 2 by means of screws 4 which pass through the clamping jaw 3 with clearance. Nuts 5 are screwed onto the threaded ends of the screws 4 in order to secure the clamping jaw 3 on the screws 4. The clamping jaw 3 comprises at its rear end a resilient bent portion 6 which is supported at one side of the clamping jaw 2. After releasing the nuts 5 the clamping jaw 3 is pressed away from the clamping jaw 2 by the action of the previously stressed and now relaxing bent portion 6 to such an extent that the cleaning tool can easily be replaced. The bent portion 6 is not absolutely necessary and may also be omitted. A replaceable cleaning tool 7 in the shape of a wiper made of rubber resilient material is inserted in a mounting 8 being U-shaped in cross section. The cleaning tool 7 is mounted by means of its mounting 8 between the clamping jaws 2 and 3 (FIG. 3). The reference numeral 9 designates a handle which has at its front end an elongation 11 forming together with the handle 9 an offset portion 10, said elongation 11 being integrally formed with the handle 9 from plastic material. The clamping jaw 2 rests against the inner side of the elongation 11 by means of an extension 12 The extension 12 comprises a hollow cylindrical projection 14 having smooth inner walls and being coaxial with a through bore 13 provided in the extension 12, by means of which projection 14 the extension 12 is rotatably mounted in the elongation 11 of the handle 9. The clamping jaw 2 is connected to the handle 9 or its elongation 11, respectively, by means of a hinged bolt 15 which passes with its threaded shaft through the projection 14 and the through bore 13 and is screwed into a nut 16 provided in the extension 12 of the clamping jaw 2 so as to be secured against rotation. By tightening the hinged bolt 15 against the elongation 11 of the handle 9 the clamping jaw 2 is connected to the elongation 11 in such a manner that it is hardly movable At the broad side of the extension 12 of the clamping jaw 2 which faces away from the elongation 11 of the handle 9 an arcuately shaped coarse toothing 17 has been produced, the teeth 18 of which comprise at their blunt faces a fine toothing 19. A stop lever 20 formed as a slide is guided in the hollow handle 9 and comprises at its front end an inwardly directed widening 21. The stop lever 20 has at its front end a tooth-like extension 22 and passes with a hollow cylindrical grip 23 through a slot 24 extending longitudinally in the wall of the handle 9. The grip 23 projects with its rear end into the interior of the handle 9. The reference numeral 25 designates a U-shapedly bent, prestressed compression spring which is supported with one leg 26 at the inner wall of the handle 9 and is secured with its other leg 27 at an insert 28 which is firmly inserted in the rear end of the grip 23. It is also possible to produce the compression spring 25 integrally with the grip 23 from plastic material.

The clamping jaws 2 and 3 are usually arranged rectangularly relative to the handle 9. In order to change the angular position of the clamping jaws 2 and 3 or the cleaning tool 7, respectively, relative to the handle 9, the stop lever 20 is disengaged from the toothing 17 by slidingly pressing its grip 23 and thereafter, the clamping jaws 2 and 3 are pivoted into the desired angular position. Thereafter, the stop lever 20 is engaged by slidingly pressing its grip 23 into one of the gaps of the toothing 17 which corresponds to the angular position of the clamping jaws 2 and 3. The stop lever 20 is secured in both engagement positions by means of the compression spring 25. For the case that an arresting of the clamping jaws 2 and 3 in the adjusted angular position is not possible by means of the toothing 17, use is made of the fine toothing 19 into which the stop lever 20 engages with its tooth-like projection 22 and is also again disengaged from the fine toothing 19 in the manner described above.

The invention may be embodied in other specific forms without departing from the spirit or essential characteristics thereof. The embodiment is therefore to be considered in all respects as illustrative and not restrictive.

What is claimed is:

1. Apparatus for cleaning window panes comprising:

(a) a shaft-like handle member;

(b) an elongated blade for contacting and cleaning said window panes;

(c) a clamping member for securing said elongated blade;

(d) means for pivotally securing said clamping member to said handle for pivotal movement about an axis transverse to the axes of said elongated blade and said handle and for adjusting the amount of frictional resistance to pivotal movement between said clamping and handle members, whereby the angular relationship between the axes of said elongated blade and shaft-like handle member may be adjusted; and (e) means for releasably, positively locking said clamping member in any one of a plurality of pivotal positions, said locking means comprising a plurality of large teeth with recesses therebetween in one of said clamping and handle members and arranged about and spaced from said pivotal axis and a locking member mounted on the other of said clamping and handle members adapted for selective insertion in any one of said recesses, whereby said clamping and handle members may be locked in any one of a plurality of predetermined pivotal positions relative to each other.

2. Apparatus according to claim 1 wherein said handle and clamping members have corresponding surfaces contacting each other and a bore passing through both said members at said pivotal axis and wherein said pivotal securing means comprises screw means passing through said bore for retaining said corresponding surfaces of said handle and clamping members in contact with each other and for adjusting the compressive pressure applied to said members and the corresponding frictional resistance to pivotal movement between said members.

3. Apparatus according to claim 1 wherein said handle and clamping membes have corresponding surfaces contacting each other, one of said members having a cylindrical aperture passing through said surface of said one member at said pivotal axis and the other member having a cylindrical portion projecting from said surface at said pivotal axis and projecting into said aperture in said one member and wherein said pivotal securing means comprises a screw member engaging said cylindrical portion and having a head engaging said one member for retaining said corresponding surfaces of said handle and clamping members in contact with each other and for adjusting the compressive pressure applied to said members and the corresponding frictional resistance to pivotal movement between said members.

4. Apparatus according to claim 1 wherein said locking means further comprises a plurality of small teeth on each of said large teeth and said slidable locking member on said handle member further comprises a tooth projecting therefrom adapted for selective engagement between any pair of adjacent of said small teeth, whereby said clamping member may be secured in any one of a plurality of pivotal positions between said predetermined pivotal positions.

5. Apparatus according to claim 2 wherein said locking means further comprises a plurality of small teeth on each of said large teeth and said slidable locking member on said handle member further comprises a tooth projecting therefrom adapted for selective engagement between any pair of adjacent of said small teeth, whereby said clamping member may be secured in any one of a plurality of pivotal positions between said predetermined pivotal positions.

6. Apparatus according to claim 3 wherein said locking means further comprises a plurality of small teeth on each of said large teeth and said slidable locking member on said handle member further comprises a tooth projecting therefrom adapted for selective engagement between any pair of adjacent of said small teeth, whereby said clamping member may be secured in any one of a plurality of pivotal positions between said predetermined pivotal positions.

* * * * *